US012202690B2

(12) United States Patent
Momiyama et al.

(10) Patent No.: US 12,202,690 B2
(45) Date of Patent: Jan. 21, 2025

(54) PATH SWITCHER, AND MEDIUM-TRANSPORTING DEVICE AND MEDIUM-PROCESSING APPARATUS INCLUDING THE SAME

(71) Applicant: FUJIFILM Business Innovation Corp., Tokyo (JP)

(72) Inventors: Hiroyuki Momiyama, Kanagawa (JP); Yusuke Itozaki, Kanagawa (JP); Makio Uehara, Kanagawa (JP); Toshitaka Tanaka, Kanagawa (JP); Masashi Matsumoto, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 194 days.

(21) Appl. No.: 17/950,872

(22) Filed: Sep. 22, 2022

(65) Prior Publication Data

US 2023/0312296 A1 Oct. 5, 2023

(30) Foreign Application Priority Data

Mar. 29, 2022 (JP) ..... 2022-052970

(51) Int. Cl.
*B65H 29/58* (2006.01)
*B65H 29/60* (2006.01)
*B65H 85/00* (2006.01)

(52) U.S. Cl.
CPC ..... *B65H 29/58* (2013.01); *B65H 29/60* (2013.01); *B65H 85/00* (2013.01);
(Continued)

(58) Field of Classification Search
CPC ..... B65H 29/58; B65H 29/60; B65H 85/00; B65H 2301/3124; B65H 2301/3125;
(Continued)

(56) References Cited

U.S. PATENT DOCUMENTS 6,446,958 B1 * 9/2002 Sette ..... B65H 29/60 271/902
2007/0252323 A1 * 11/2007 Mandel ..... B65H 29/60 271/203

(Continued)

FOREIGN PATENT DOCUMENTS

JP 4729966 B2 7/2011

*Primary Examiner* — Prasad V Gokhale
(74) *Attorney, Agent, or Firm* — Oliff PLC

(57) ABSTRACT

A path switcher is provided at a point where a transport path along which a medium is to be transported branches out into a first branch path and a second branch path that are to be switched between by the path switcher. The path switcher includes: a switching component including a first arm and a second arm, the first arm being swingable at the point of branching of the transport path, the second arm being connected to a distal end of the first arm with an aid of a motion-allowing part, the switching component being configured to close one of the first branch path and the second branch path while opening an other of the first branch path and the second branch path; an elastic retaining component provided around the motion-allowing part and configured to elastically retain the first arm and the second arm in a predetermined positional relationship; and a rotary component rotatably provided at a distal end of the second arm and that is to come into contact with the medium.

10 Claims, 9 Drawing Sheets

(52) U.S. Cl.
CPC .... *B65H 2402/54* (2013.01); *B65H 2404/632* (2013.01); *B65H 2801/06* (2013.01)

(58) Field of Classification Search
CPC ..... B65H 2402/54; B65H 2404/63; B65H 2404/631; B65H 2404/632
See application file for complete search history.

(56) References Cited

U.S. PATENT DOCUMENTS

| | | | | |
|---|---|---|---|---|
| 2011/0262151 | A1* | 10/2011 | Ise | B65H 3/44 399/45 |
| 2013/0084119 | A1* | 4/2013 | Iijima | G03G 15/6552 400/611 |
| 2020/0209797 | A1* | 7/2020 | Ikegami | G03G 15/6552 |

* cited by examiner

PATH SWITCHER, AND MEDIUM-TRANSPORTING DEVICE AND MEDIUM-PROCESSING APPARATUS INCLUDING THE SAME

CROSS-REFERENCE TO RELATED APPLICATIONS

This application is based on and claims priority under 35 USC 119 from Japanese Patent Application No. 2022-052970 filed Mar. 29, 2022.

BACKGROUND

(i) Technical Field

The present disclosure relates to a path switcher configured to switch the path along which a medium advances, and a medium-transporting device and a medium-processing apparatus each including the path switcher.

(ii) Related Art

Existing techniques relating to such a medium-transporting device include the one disclosed by Japanese Patent No. 4729966 (Description of Embodiments and FIG. 1), for example.

Japanese Patent No. 4729966 (Description of Embodiments and FIG. 1) relates to a paper-transporting technique in which a paper transport path on the downstream side relative to a nip part of a fixing device is secured between a guiding member and a supporting member provided across from the guiding member. The guiding member has a rib on which a transporting roller is provided. The supporting member is located close to the guiding member. When paper comes into contact with the supporting member, the paper receives a force acting in a direction toward the transporting roller.

SUMMARY

Aspects of non-limiting embodiments of the present disclosure relate to an operation of switching a transport path for a medium by using a switching gate provided at a point where the transport path branches out and to reducing the damage to the medium that may occur when the medium comes into contact with the distal end of the switching gate.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a path switcher provided at a point where a transport path along which a medium is to be transported branches out into a first branch path and a second branch path that are to be switched between by the path switcher, the path switcher including: a switching component including a first arm and a second arm, the first arm being swingable at the point of branching of the transport path, the second arm being connected to a distal end of the first arm with an aid of a motion-allowing part, the switching component being configured to close one of the first branch path and the second branch path while opening an other of the first branch path and the second branch path; an elastic retaining component provided around the motion-allowing part and configured to elastically retain the first arm and the second arm in a predetermined positional relationship; and a rotary component rotatably provided at a distal end of the second arm and that is to come into contact with the medium.

BRIEF DESCRIPTION OF THE DRAWINGS

Exemplary embodiments of the present disclosure will be described in detail based on the following figures, wherein.

DETAILED DESCRIPTION

General Embodiment

Figure 1A:
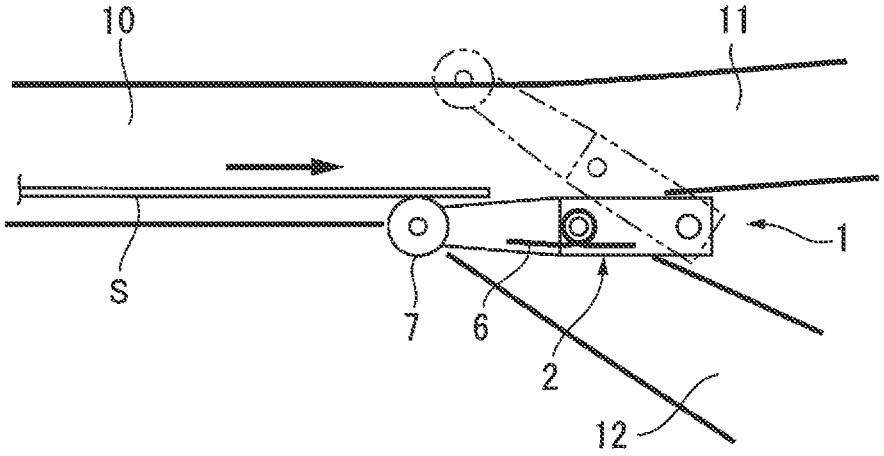
FIG. 1A illustrates a medium-transporting device including a path switcher according to a general embodiment of the present disclosure.

FIG. 1A illustrates a medium-transporting device including a path switcher according to a general embodiment of the present disclosure.

The medium-transporting device illustrated in FIG. 1A includes a first branch path 11 and a second branch path 12 branching out from a transport path 10 along which a medium S is to be transported, a path switcher 1 provided at a point of branching between the first branch path 11 and the second branch path 12, and a transporting component (not illustrated) configured to transport the medium S.

Figure 1B:
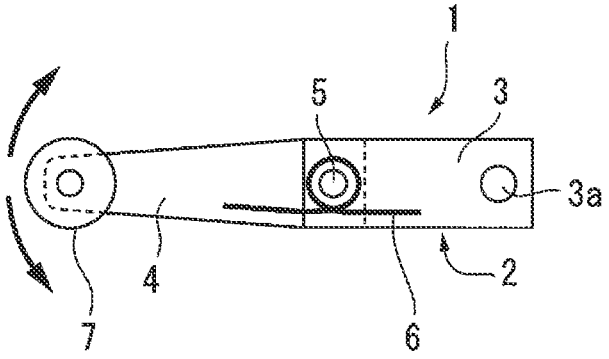
FIG. 1B illustrates relevant elements of the path switcher illustrated in FIG. 1A.

In the general embodiment, as illustrated in FIGS. 1A and 1B, the path switcher 1 is provided at the point where the transport path 10 along which the medium S is to be transported branches out into the first branch path 11 and the second branch path 12, which are to be switched between by the path switcher 1. The path switcher 1 includes a switching component 2, an elastic retaining component 6, and a rotary component 7. The switching component 2 includes a first arm 3 and a second arm 4. The first arm 3 is swingable at the point of branching of the transport path 10. The second arm 4 is connected to the distal end of the first arm 3 with the aid of a motion-allowing part 5. The switching component 2 is configured to close one of the first branch path 11 and the second branch path 12 while opening the other. The elastic retaining component 6 is provided around the motion-allowing part 5 and elastically retains the first arm 3 and the second arm 4 in a predetermined positional relationship. The rotary component 7 is rotatably provided at the distal end of the second arm 4 and is to come into contact with the medium S.

Such a medium-transporting device is included in a medium-processing apparatus including a processing component (not illustrated) configured to perform a predetermined processing operation on a medium S, in which the medium-transporting device transports the medium S to the processing component or serves as a device that embodies a function of transporting the medium S processed by the processing component.

The term "processing component" used herein encompasses an imaging component configured to form an image on a medium S, and various other components configured to perform processing operations such as punching, cutting, sorting, and folding on a medium S.

In such a technical feature, the path switcher 1 is configured to switch the transport path between the two branch paths 11 and 12 and includes the swingable switching component 2, the elastic retaining component 6, and the rotary component 7.

The switching component 2 is obtained by connecting the second arm 4 to the first arm 3 with the aid of the motion-allowing part 5.

In the general embodiment, the first arm 3 is supported in such a manner as to be swingable about a pivot 3*a*. The pivot 3*a* is to be provided at a position between the first branch path 11 and the second branch path 12 and where the medium S does not pass.

The second arm 4 is movable relative to the first arm 3 within a range allowed by the motion-allowing part 5. The first and second arms 3 and 4 are elastically retained at respective predetermined positions by the elastic retaining component 6. Therefore, when the second arm 4 moves from the predetermined position, the second arm 4 receives an urging force generated by the elastic retaining component 6 in such a direction as to return the second arm 4 to the predetermined position. Hence, the elastic retaining component 6 is also regarded as an elastic member configured to return the distal end of the second arm 4 to the original position when the distal end of the second arm 4 is displaced relative to the distal end of the first arm 3.

The rotary component 7 may typically be a runner roller that is rotatable on the axis thereof.

In the general embodiment employing the above configuration, the switching component 2 has the following functions: a basic path-switching function in which the combination of the first arm 3 and the second arm 4 swings about the pivot 3*a*, and a damage-reducing function in which the damage to the medium S that may occur when the medium S comes into contact with the distal end of the switching component 2 is reduced.

The damage-reducing function according to the general embodiment is exerted as follows. When a medium S advancing toward the distal end of the switching component 2 comes into contact with the rotary component 7 and applies a contact pressure to the rotary component 7, the rotary component 7 slightly retracts against the urging force exerted by the elastic retaining component 6. Accordingly, the contact pressure between the medium S and the rotary component 7 is reduced. Therefore, the medium S is not strongly pressed against the rotary component 7 of the switching component 2 but causes the rotary component 7 to rotate and is directed by the switching component 2 toward the opened one of the branch paths 11 and 12. In such a respect, the distal end of the switching component 2 is not formed as a fixed part but is provided with the rotary component 7. The rotary component 7 comes into contact with the medium S at an appropriate contact pressure.

Now, a typical example of the path switcher 1 according to the general embodiment will be described.

In the typical example of the path switcher 1, the first arm 3 is a flat plate extending in the width direction of the medium S that intersects the direction of transport of the medium S. The second arm 4 is a stick and is one of a plurality of second arms 4 arranged in the form of comb teeth at predetermined intervals in the width direction of the medium S. The rotary component 7 is one of a plurality of rotary components 7 provided to all or some of the plurality of second arms 4 in such a manner as to be arranged at intervals.

In the typical example, the first branch path 11 and the second branch path 12 are each defined by a defining member (not illustrated). The defining member has a recess in which the second arms 4 and the rotary components 7 are to be placed as a result of the switching motion of the switching component 2. The recess of the defining member may have a space large enough for the second arms 4 to retract thereinto when the medium S comes into contact with the rotary components 7. Such a configuration allows the second arms 4 to retract relative to the first arm 3 with the aid of the motion-allowing part 5 when the medium S comes into contact with the rotary components 7. Thus, the impact applied from the distal end of the switching component 2 to the medium S is reduced.

In view of causing the medium S to appropriately come into contact with the rotary components 7, an outer peripheral portion of each of the rotary components 7 may project toward the first branch path 11 or the second branch path 12 relative to the second arm 4 at a position where the rotary component 7 is attached to the second arm 4. In such a configuration, the second arm 4 may be thinner on the side where the rotary component 7 is attached to the second arm 4 than on the side where the second arm 4 is connected to the first arm 3.

In view of securing a long locus of swing of the switching component 2 about the pivot 3*a*, the elastic retaining component 6 may be configured to retain the first arm 3 and the second arm 4 to be aligned in a substantially straight line. In the typical example, the elastic retaining component 6 may be a helical torsion spring wound around the motion-allowing part 5 and including two end hooks that are respectively made to engage with the first arm 3 and the second arm 4.

The present disclosure will further be detailed on the basis of an exemplary embodiment illustrated in the other accompanying drawings.

Exemplary Embodiment

Figure 2:
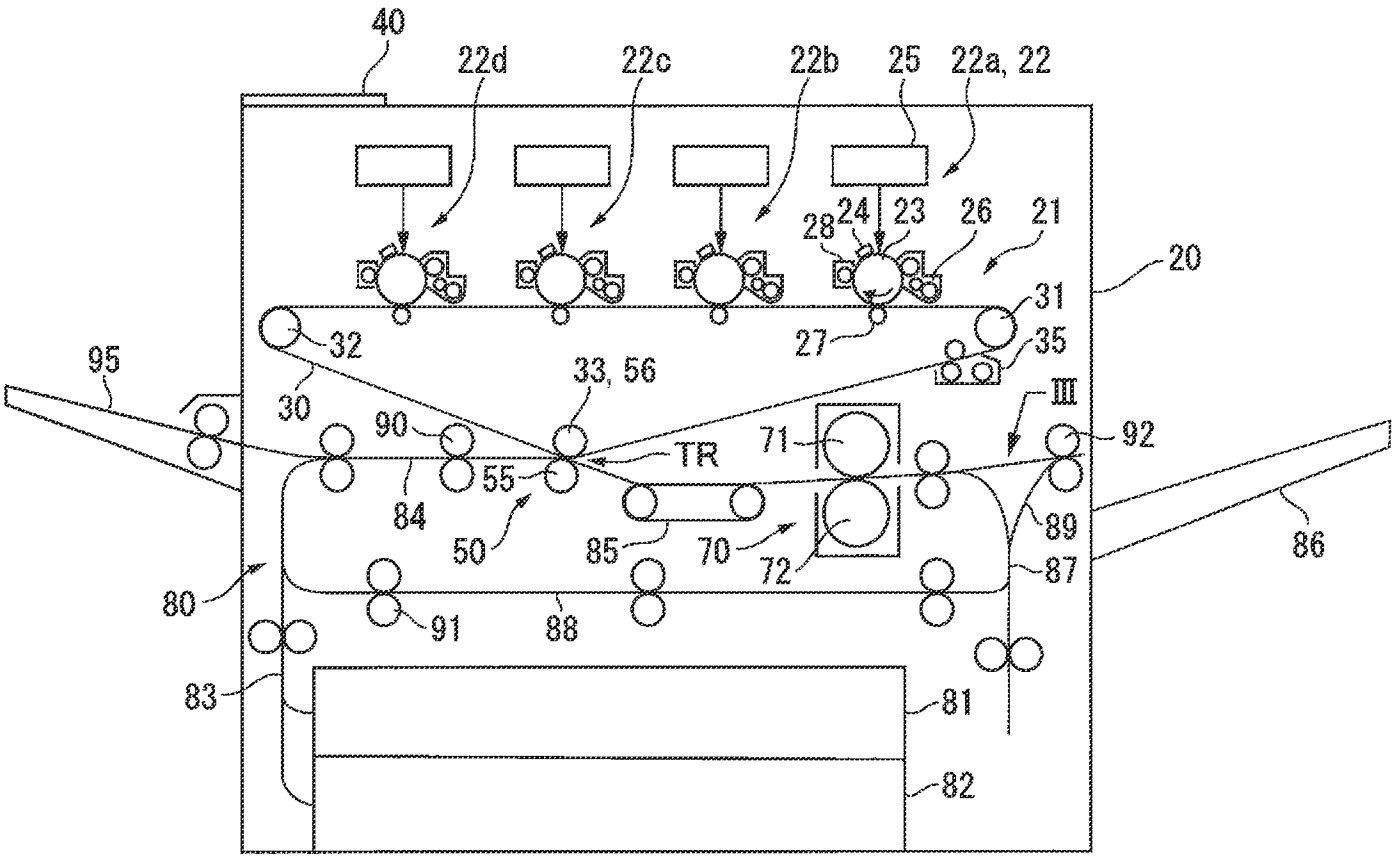
FIG. 2 outlines an image forming apparatus serving as a medium-processing apparatus according to an exemplary embodiment.

FIG. 2 outlines an image forming apparatus serving as a medium-processing apparatus according to the present exemplary embodiment.

Overall Configuration of Image Forming Apparatus

The image forming apparatus illustrated in FIG. 2 basically includes, in an apparatus housing 20, an imaging engine 21, a medium-transporting system 80, and a fixing device 70. The imaging engine 21 is configured to form an image composed of, for example, a plurality of color components. The medium-transporting system 80 is located below the imaging engine 21 and is configured to transport a medium to the imaging engine 21. The fixing device 70 is configured to fix the image formed by the imaging engine 21 to the medium.

The imaging engine 21 according to the present exemplary embodiment includes image forming units 22 (specifically, 22a to 22*d*), a belt-type intermediate transfer body 30, and a second-transfer device (collective transfer device) 50. The image forming units 22 are configured to form respective images in respective general color components (in the present exemplary embodiment, yellow (Y), magenta (M), cyan (C), and black (K)). The color-component images formed by the respective image forming units 22 are sequentially transferred to the intermediate transfer body 30 one of top of another (a first-transfer process). The color-component images thus carried by the intermediate transfer body 30 are transferred (collectively transferred) to a medium (a piece of paper or a film) by the second-transfer device 50 in a second-transfer process. The image forming apparatus illustrated in FIG. 2 is operated on an operation panel 40.

Image Forming Unit

The image forming units 22 (22*a* to 22*d*) according to the present exemplary embodiment each include a drum-type photoconductor 23, which is surrounded by a charging device 24, an exposure device 25, a developing device 26, a first-transfer device 27, and a photoconductor-cleaning device 28. The charging device 24 is a corotron, a transfer roll, or the like and is configured to charge the photoconductor 23. The exposure device 25 is a laser scanning device or the like and is configured to form an electrostatic latent image on the charged photoconductor 23. The developing device 26 is configured to develop the electrostatic latent image on the photoconductor 23 into a toner image with a toner of a corresponding one of the color components of Y, M, C, and K. The first-transfer device 27 is a transfer roll or the like and is configured to transfer the toner image from the photoconductor 23 to the intermediate transfer body 30. The photoconductor-cleaning device 28 is configured to remove residual toner particles from the photoconductor 23.

The intermediate transfer body 30 is stretched around a plurality (three in the present exemplary embodiment) of stretching rolls 31 to 33. The stretching roll 31, for example, serves as a driving roll to be driven by a driving motor (not illustrated). The intermediate transfer body 30 is rotated by the driving roll. The image forming apparatus further includes an intermediate-transfer-body-cleaning device 35, which is provided between the stretching rolls 31 and 33 and is configured to remove residual toner particles from a part of the intermediate transfer body 30 that has undergone the second-transfer process.

Second-Transfer Device (Collective Transfer Device)

The second-transfer device (collective transfer device) 50 is configured as follows, for example. A transfer roll 55 is pressed against the intermediate transfer body 30 at a position supported by the stretching roll 33. The stretching roll 33 supporting the intermediate transfer body 30 serves as a counter roll 56, which serves as a counter electrode for the transfer roll 55. In the present exemplary embodiment, the transfer roll 55 includes a metal shaft provided therearound with an elastic layer made of a material such as urethane foam rubber or ethylene-propylene terpolymer (EPDM) containing carbon black or the like. A transfer voltage generated by a transfer power source (not illustrated) is applied to the counter roll 56 (also serving as the stretching roll 33 in the present exemplary embodiment) through a power-feeding roll (not illustrated) that is electrically conductive. Meanwhile, the transfer roll 55 is grounded. Thus, a predetermined transfer electric field is generated between the transfer roll 55 and the counter roll 56. A site where the intermediate transfer body 30 is nipped between the transfer roll 55 and the counter roll 56 serves as a second-transfer site (collective transfer site) TR. While the second-transfer device 50 according to the present exemplary embodiment employs the transfer roll 55, the second-transfer device 50 is not limited thereto. Needless to say, the second-transfer device 50 may be a transfer-belt module or the like including the transfer roll 55 serving as one of stretching rolls around which a transfer belt is stretched.

Fixing Device

The fixing device 70 includes a thermal fixing roll 71 and a pressure fixing roll 72. The thermal fixing roll 71 is positioned to be in contact with an image-carrying surface of the medium and is rotatable when driven. The pressure fixing roll 72 is pressed against the thermal fixing roll 71 and rotates by following the thermal fixing roll 71. The fixing device 70 allows the medium having an image to pass through a fixing site, which is defined between the two fixing rolls 71 and 72. Thus, the image is fixed with heat and pressure applied thereto.

The thermal fixing roll 71 includes, for example, a heater provided inside a roll body thereof or is provided with an external heater to be brought into contact with the outer peripheral surface of the roll body, so that the roll body is heated. Needless to say, the pressure fixing roll 72 may also be provided with a heater. While the present exemplary embodiment concerns a case where the fixing device 70 employs a pair of rolls, the fixing device 70 is not limited thereto and may be selected from any of various devices. For example, the thermal fixing roll 71 may be replaced with a thermal fixing belt employing an induction heating scheme.

Medium-Transporting System

The medium-transporting system 80 includes a plurality (two in the present exemplary embodiment) of medium-supplying containers 81 and 82. In the medium-transporting system 80, a medium supplied from either of the medium-supplying containers 81 and 82 is transported to the second-transfer site TR through a vertical transport path 83, which extends substantially vertically, and a horizontal transport path 84, which extends substantially horizontally. Subsequently, the medium having received an image transferred thereto is transported by a transporting belt 85 to the fixing site in the fixing device 70, and is discharged to an output-medium receiver 86, which is provided on a lateral face of the apparatus housing 20.

The medium-transporting system 80 further includes a transport-path branch 87, which branches off downward from the horizontal transport path 84 at a position on the downstream side relative to the fixing device 70 in the direction of transport of the medium. The medium is turned over by being transported along the transport-path branch 87. The medium thus turned over in the transport-path branch 87 is transported into a return transport path 88, is fed into the vertical transport path 83 again, and is transported along the horizontal transport path 84 to the second-transfer site TR, where another image is transferred to the back side of the medium. Subsequently, the medium passes through the fixing device 70 and is discharged to the output-medium receiver 86. The transport-path branch 87 branches out at a halfway point thereof to form a branch return path 89. The medium having been turned over is transported along the branch return path 89 toward the output-medium receiver 86.

The medium-transporting system 80 further includes a registration roll 90, which sets the medium in position and then supplies the medium to the second-transfer site TR; an appropriate number of transporting rolls 91, which are provided in the transport paths 83, 84, 87, 88, and 89; and an output roll 92, which is provided at the exit of the horizontal transport path 84 to the output-medium receiver 86. Furthermore, the apparatus housing 20 is provided with a manual medium-feeding device 95, which is located opposite the output-medium receiver 86 and allows the manual feeding of a medium into the horizontal transport path 84.

Figure 3:
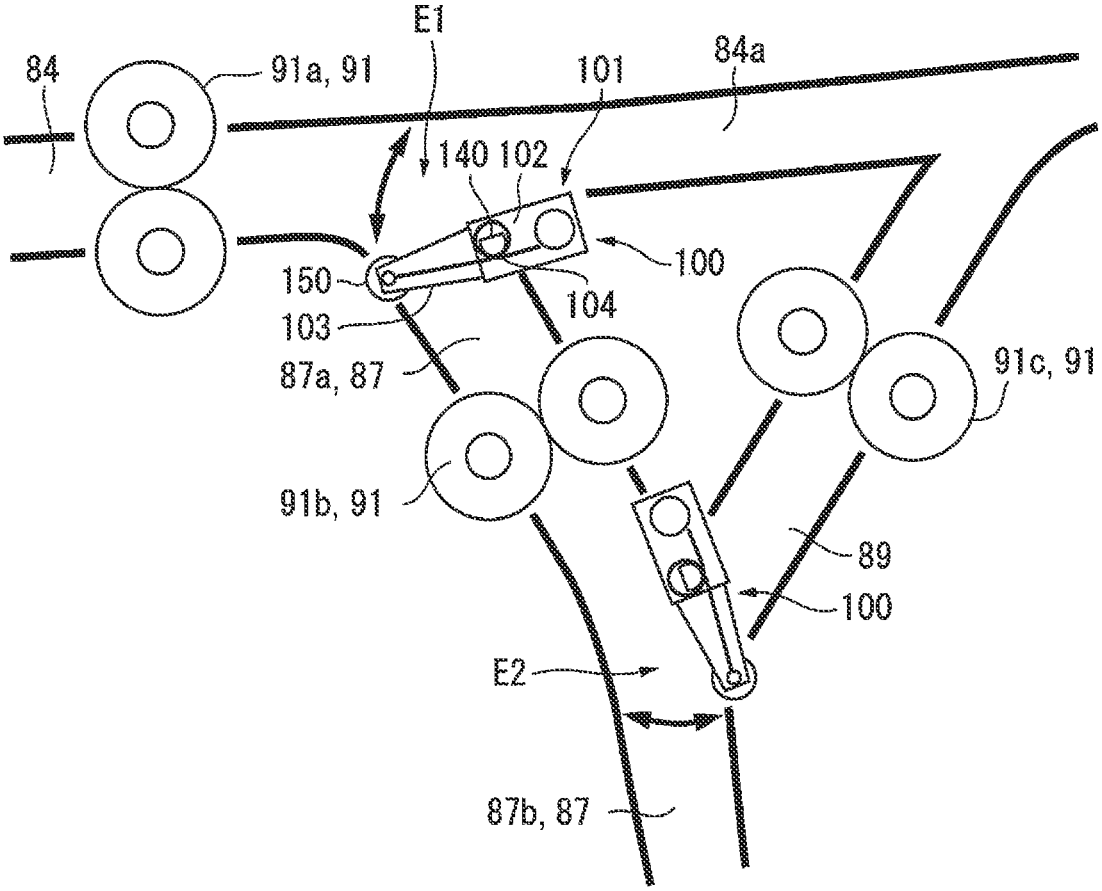
FIG. 3 details a part of FIG. 2 that is denoted by III.

Exemplary Branching Configuration of Transport Path Branching Point in Horizontal Transport Path Referring to FIGS. 2 and 3, the horizontal transport path 84 according to the present exemplary embodiment branches out at a halfway point thereof into two paths: the transport-path branch 87 and a straightforward transport path 84*a*. The transport-path branch 87 extends downward and is intended to turn over the medium. The straightforward transport path 84*a* is a part of the horizontal transport path 84 and extends straight ahead toward the output-medium receiver 86.

The straightforward transport path 84*a* corresponds to the first branch path in FIG. 1A, and the transport-path branch 87 corresponds to the second branch path in FIG. 1A.

A path switcher 100 is provided in the horizontal transport path 84 at a branching point E1 (between the straightforward transport path 84*a* and the transport-path branch 87). A medium S transported from the upstream side along the horizontal transport path 84 is allowed to advance into one of the straightforward transport path 84*a* corresponding to the first branch path and the transport-path branch 87 corresponding to the second branch path that are switched between by the path switcher 100.

Branching Point in Transport-Path Branch

The transport-path branch 87 branches out at a branching point E2 to form the branch return path 89, which extends obliquely upward. With reference to the branching point E2 between the transport-path branch 87 and the branch return path 89, an upper transport-path branch 87*a* extends upward while a lower transport-path branch 87*b* extends downward. Seen from the lower transport-path branch 87*b*, the transport path branches into two paths: the upper transport-path branch 87*a* and the branch return path 89.

In this case, the upper transport-path branch 87*a* corresponds to the first branch path in FIG. 1A, and the branch return path 89 corresponds to the second branch path in FIG. 1A. The transport-path branch 87 is provided at the branching point E2 with another path switcher 100, whereby the upper transport-path branch 87*a* and the branch return path 89 are switched between.

As illustrated in FIG. 2, the transport-path branch 87 further branches out laterally to form the return transport path 88 at yet another branching point, where yet another path switcher (not illustrated) is provided.

Exemplary Arrangement of Transporting Rolls

Referring to FIG. 3, the horizontal transport path 84 is provided at a position thereof immediately before the branching point E1 with a transporting roll 91*a* (91). The upper transport-path branch 87*a* included in the transport-path branch 87 may be provided with a transporting roll 91*b* (91), and the branch return path 89 may be provided with a transporting roll 91*c* (91).

Exemplary Configuration of Path Switcher

In the present exemplary embodiment, the path switcher 100 is provided at each of the branching point E1 in the horizontal transport path 84, the branching point E2 in the transport-path branch 87, and other locations. All the path switchers 100 have the same configuration. Therefore, in the present exemplary embodiment, the path switcher 100 provided at the branching point E1 in the horizontal transport path 84 will be described as an example.

Switching Gate

Figure 4:
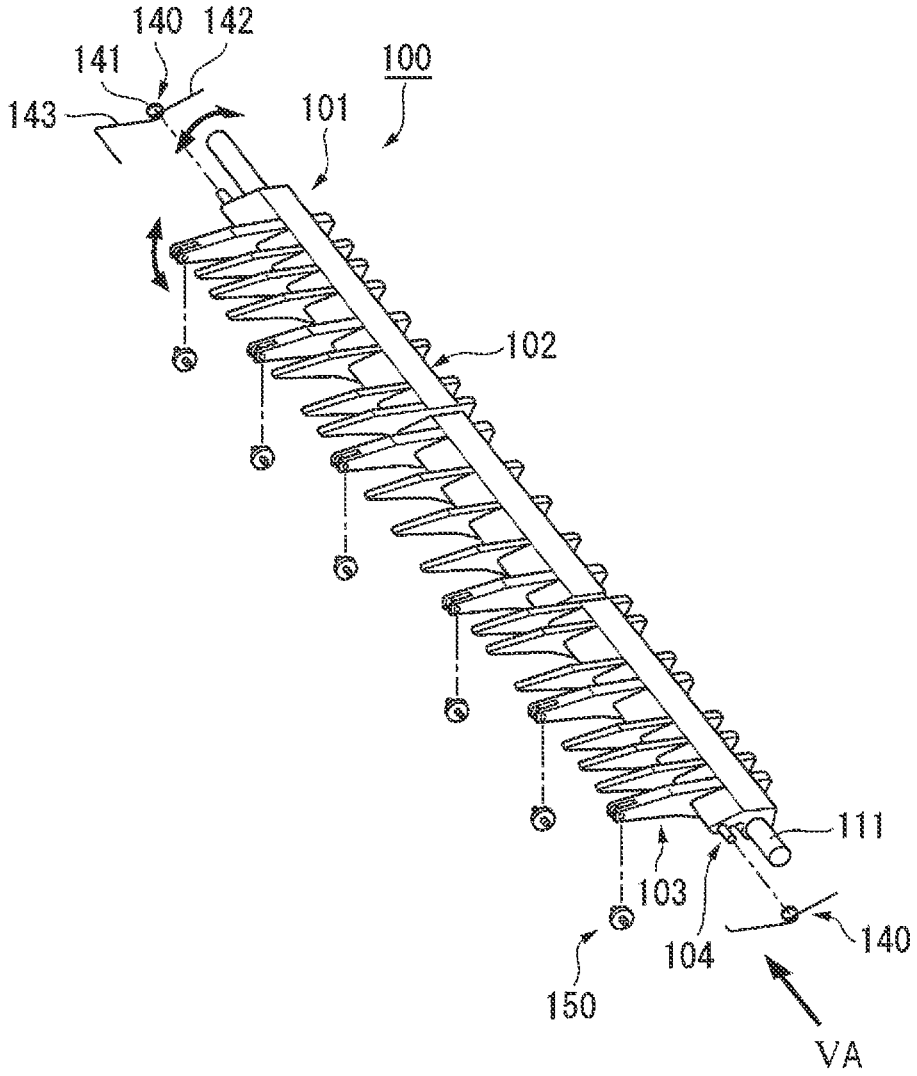
FIG. 4 is a perspective view of the entirety of the path switcher according to the exemplary embodiment.
Figure 5A:
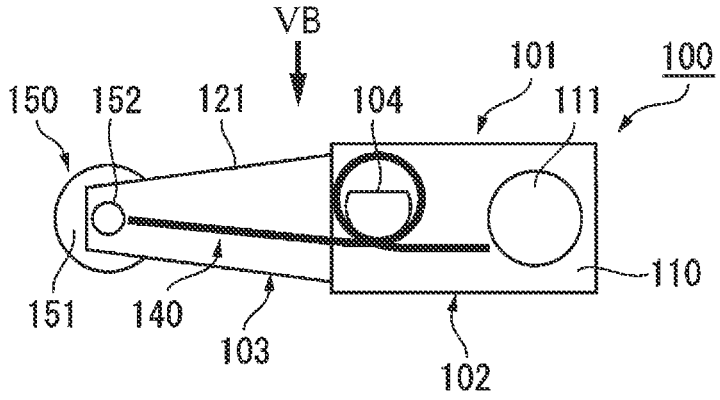
FIG. 5A illustrates the path switcher seen in the direction of arrow VA provided in FIG. 4.
Figure 5B:
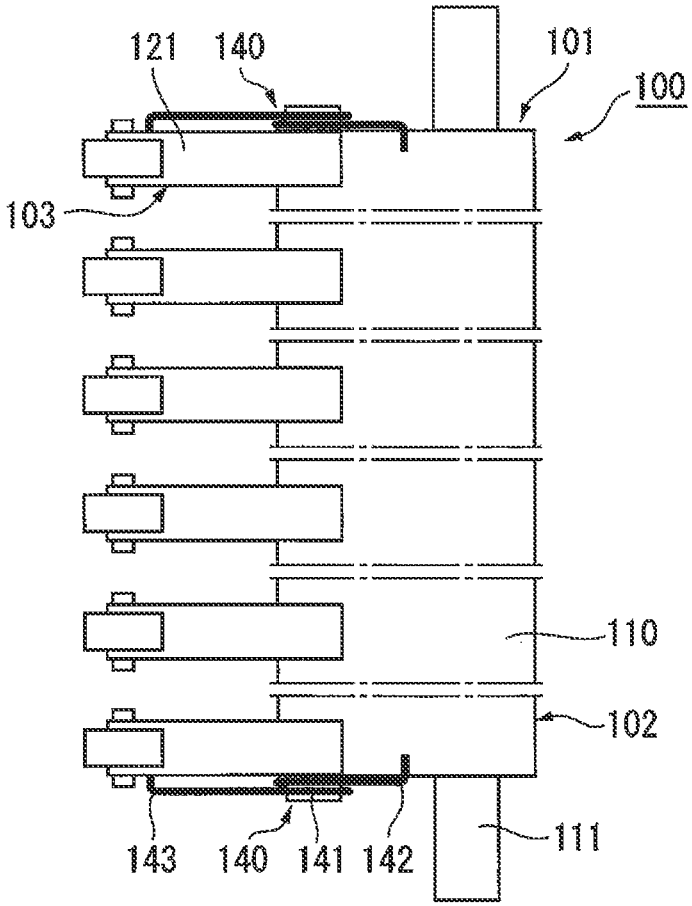
FIG. 5B illustrates the path switcher seen in the direction of arrow VB provided in FIG. 5A.

Referring to FIG. 3, the path switcher 100 according to the present exemplary embodiment includes a switching member, which serves as a switching component that switches the transport path between the straightforward transport path 84*a* corresponding to the first branch path and the transport-path branch 87 corresponding to the second branch path. In the present exemplary embodiment, a switching gate 101 is employed as the switching member. Referring to FIG. 4 and FIGS. 5A and 5B, the switching gate 101 includes a swing arm 102 and link arms 103. The swing arm 102 corresponds to the first arm and is swingable at the branching point E1. The link arms 103 correspond to the second arm and are connected to the distal end of the swing arm 102 with the aid of a motion-allowing part 104.

The swing arm 102 is molded as a single continuous member from, for example, synthetic resin such as acrylonitrile butadiene styrene (ABS) and includes an arm member 110. The arm member 110 is a flat plate extending in the width direction of the medium S that intersects the direction of transport of the medium S. The arm member 110 is provided at the proximal end thereof with a pivotal shaft 111, which corresponds to the pivot. The pivotal shaft 111 extends in the width direction of the medium S and projects from the two widthwise ends of the arm member 110. The pivotal shaft 11 is rotatably supported at the branching point E1 with the aid of bearings (not illustrated). The pivotal shaft 111 provided at the branching point E1 is located at a position where the medium S does not pass.

The link arms 103 include respective stick-like arm members 121, which are each molded as a single continuous member from, for example, synthetic resin such as ABS. The arm members 121 are arranged in the form of comb teeth at predetermined intervals in the width direction of the medium S. In side view, the arm members 121 each become thinner from the side thereof connected to the swing arm 102 toward the distal end thereof, thereby having a trapezoidal shape.

The motion-allowing part 104 includes a link shaft 131, which has a D-shaped cross section and is fixedly provided. The link shaft 131 extends in the width direction of the medium S through a D-shaped through-hole 132, which is provided in a connected part at the distal end of the arm member 110 of the swing arm 102 where the arm members 121 of the link arms 103 are connected to the swing arm 102. The through-hole 132 receives the link shaft 131 with play δ (see FIG. 6C). With the motion-allowing part 104 including the link shaft 131 extending through the through-hole 132 provided in the link arms 103, the link arms 103 are supported in such a manner as to be swingable by the play δ relative to the swing arm 102. The link arms 103 may be molded individually, or a plurality of link arms 103 may be molded altogether.

Helical Torsion Spring

In the present exemplary embodiment, a helical torsion spring 140 serves as the elastic retaining component and is provided at each of the two ends of the motion-allowing part 104. The helical torsion springs 140 each include a coil portion 141, which is wound around the motion-allowing part 104; and two end hooks 142 and 143, which are respectively made to engage with the swing arm 102 and a corresponding one of the link arms 103.

Thus, in the present exemplary embodiment, the helical torsion springs 140 elastically retain the swing arm 102 and the link arms 103 in a predetermined positional relationship. More specifically, referring to FIG. 6C, the helical torsion springs 140 retain the swing arm 102 and each of the link arms 103 to be aligned in a substantially straight line with the flat part of the wall of the D-shaped through-hole 132 being in contact with the flat face of the D-shaped link shaft 131.

Runner Rollers

In the present exemplary embodiment, referring to FIGS. 4 and 5B, some of the plurality of link arms 103 are each provided at the distal end thereof with a runner roller 150, which serves as the rotary component. In the present exemplary embodiment, six runner rollers 150 are provided at predetermined intervals.

The runner rollers 150 each include a roller body 151, through the center of which a shaft 152 extends. The shaft 152 is rotatably supported at the distal end of the arm member 121 of a corresponding one of the link arms 103. An outer peripheral portion of each of the runner rollers 150 projects toward the straightforward transport path 84*a* corresponding to the first branch path or toward the transport-path branch 87 corresponding to the second branch path relative to the arm member 121 of the link arm 103 at the distal end of the arm member 121 where the runner roller 150 is attached. In the present exemplary embodiment, since the link arm 103 is thinner on the side thereof having the runner roller 150 than on the side thereof connected to the swing arm 102, the outer peripheral portion of the runner roller 150 tends to project upward and downward relative to the distal end of the link arm 103 where the runner roller 150 is attached.

Driving System for Path Switcher

Figure 6A:
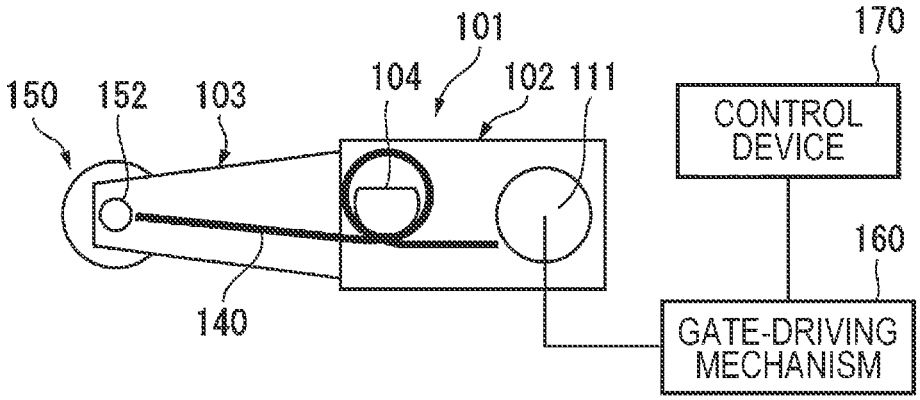
FIG. 6A outlines a driving system for the path switcher.

Referring to FIG. 6A, the switching gate 101 according to the present exemplary embodiment is provided with a gate-driving mechanism 160. The gate-driving mechanism 160 is provided at one end of the pivotal shaft 111 of the swing arm 102 and is configured to operate in Switching Mode I or Switching Mode II in accordance with a control signal received from a control device 170. In Switching Mode I, the straightforward transport path 84*a* corresponding to the first branch path is opened. In Switching Mode II, the transport-path branch 87 corresponding to the second branch path is opened.

Figure 6B:
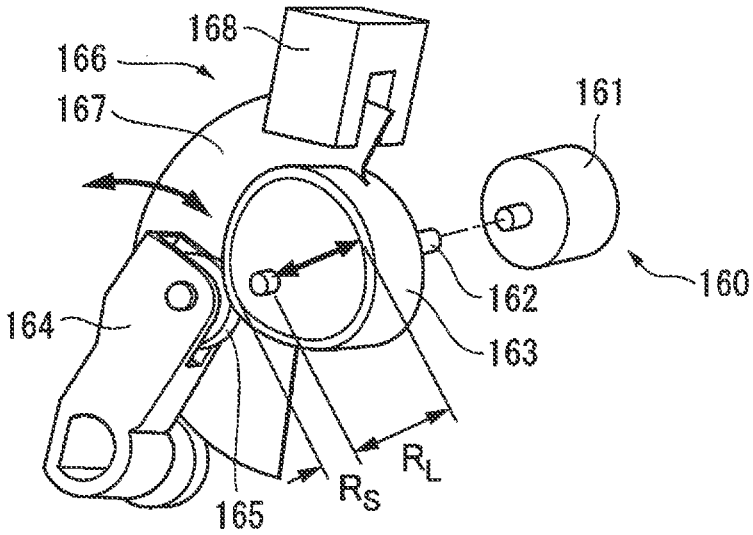
FIG. 6B illustrates an exemplary configuration of a gate-driving mechanism illustrated in FIG. 6A.
Figure 6C:
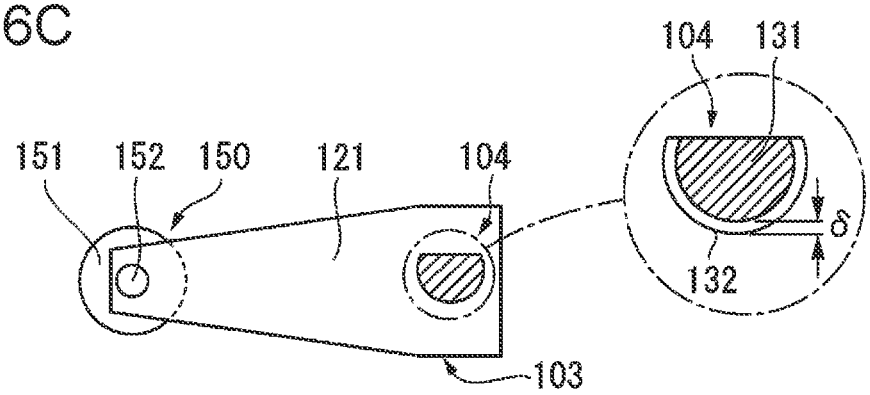
FIG. 6C illustrates an exemplary motion-allowing part provided between a swing arm and a link arm.

Referring to FIG. 6B, the gate-driving mechanism 160 according to the present exemplary embodiment includes a rotary shaft 162. The rotary shaft 162 rotates synchronously with the shaft of a gate motor 161. An eccentric cam 163 is fixed to one end of the rotary shaft 162. The eccentric cam 163 has a substantially circular shape and includes a longer-radius portion $R_L$, a shorter-radius portion $R_S$, and a cam face. The longer-radius portion $R_L$ and the shorter-radius portion $R_S$ are located across the rotary shaft 162 from each other. On the other hand, the pivotal shaft 111 of the switching gate 101 is provided with a projecting arm 164, which projects in the radial direction. The projecting arm 164 is provided at the distal end thereof with a roller 165, which is rotatably in contact with the cam face of the eccentric cam 163. The projecting arm 164 is urged against the cam face of the eccentric cam 163 by an urging spring (not illustrated).

In the present exemplary embodiment, a position detector 166 detects the angular position of the eccentric cam 163. The position detector 166 includes a semicircular light-shielding plate 167, which rotates coaxially with the eccentric cam 163. The position detector 166 is configured to detect at which of the longer-radius portion $R_L$ and the shorter-radius portion $R_S$ the eccentric cam 163 is in contact with the roller 165 of the projecting arm 164 by detecting whether an optical sensor 168, which is a photocoupler or the like, is interrupted by the light-shielding plate 167. The angular position of the eccentric cam 163 is controlled in accordance with the control signal issued by the control device 170, and the projecting arm 164 is rotated within a predetermined angular range with reference to the relationship with the longer-radius portion $R_L$ or the shorter-radius portion $R_S$ of the eccentric cam 163. Thus, the switching gate 101 is moved.

Exemplary Configuration of Elements Relevant to Path Switcher

Figure 7:
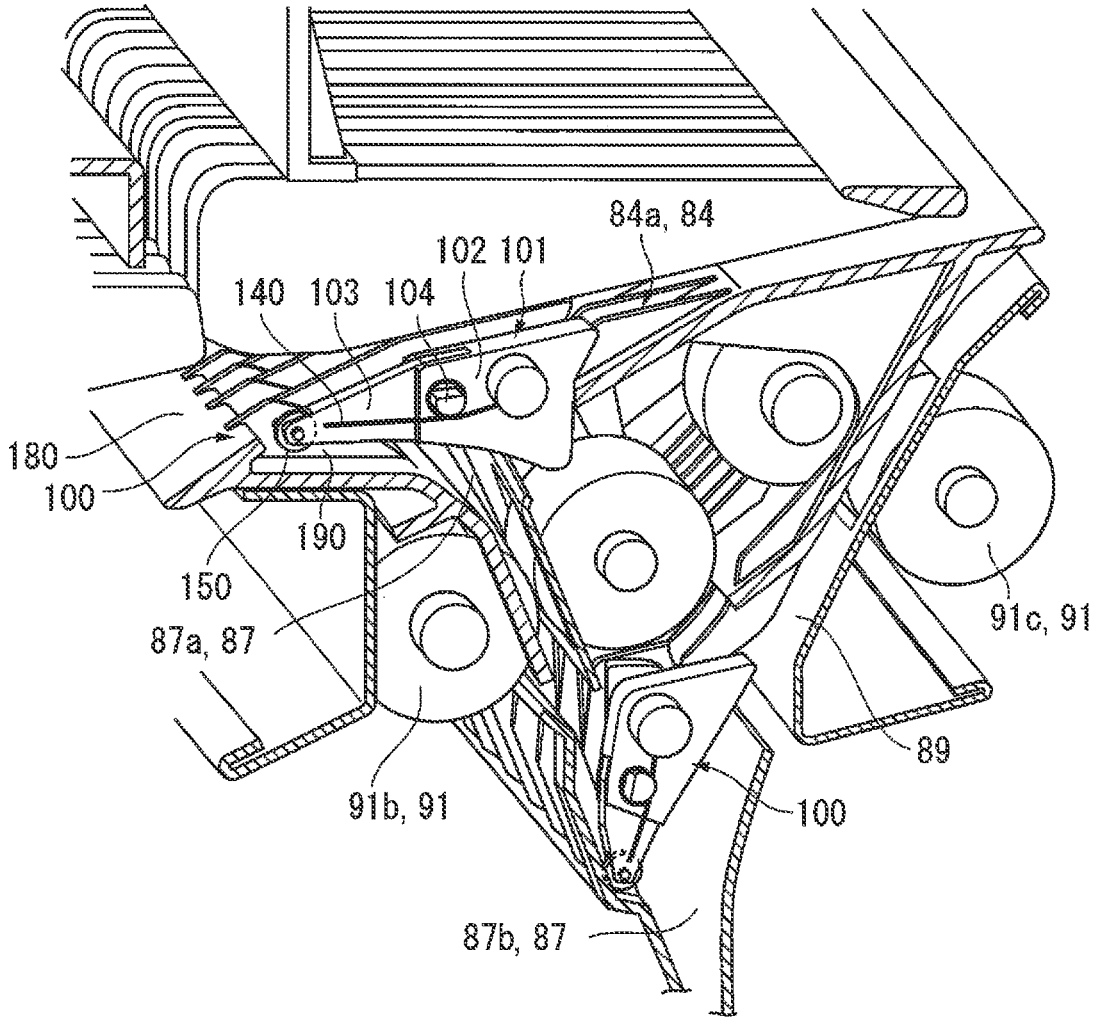
FIG. 7 illustrates an exemplary arrangement of transport paths around the path switcher.
Figure 8A:
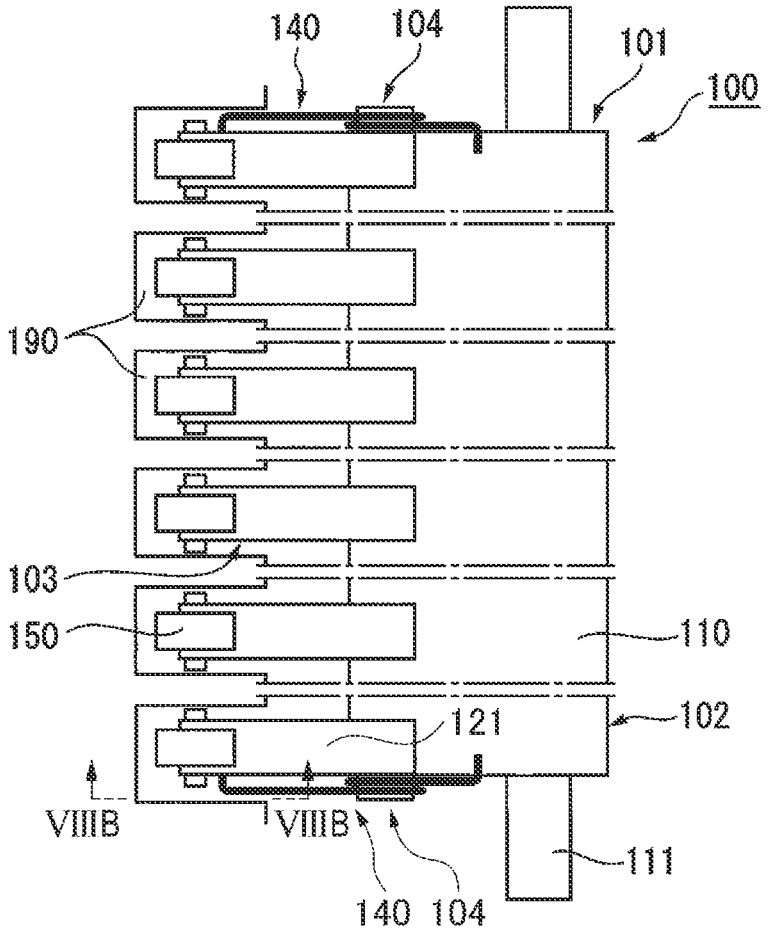
FIG. 8A illustrates the positional relationship between the path switcher and a chute that defines the transport path.
Figure 8B:
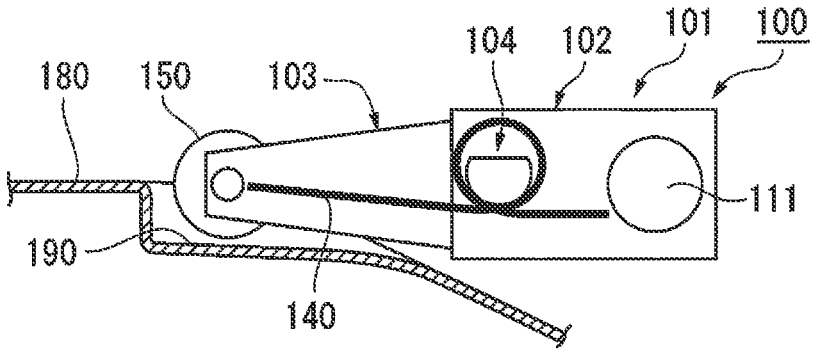
FIG. 8B illustrates a section taken along line VIIIB-VIIIB provided in FIG. 8A.

The path switcher 100 according to the present exemplary embodiment includes the switching gate 101. The switching gate 101 includes the link arms 103 arranged in the form of comb teeth. Some of the link arms 103 are provided at the distal ends thereof with the runner rollers 150. The straightforward transport path 84*a* corresponding to the first branch path and the transport-path branch 87 corresponding to the second branch path are each defined by a chute 180, which corresponds to the defining member. Referring to FIG. 7 and FIGS. 8A and 8B, the chute 180 has recesses 190, in which the link arms 103 and the runner rollers 150 are to be placed as a result of the switching motion of the switching gate 101.

In Switching Mode I or Switching Mode II, the switching gate 101 is moved to such a position as to close a corresponding one of the branch paths. The recesses 190 are to be recessed at least to such an extent as to be able to receive the link arms 103 and the runner rollers 150 therein but not to allow the medium S to be drawn into the branch path that is closed by the switching gate 101.

Specifically, at least a portion of each of the runner rollers 150 is to be placed within a corresponding one of the recesses 190. In addition, the runner rollers 150 may be out of contact with the bottoms of the recesses 190. To introduce the medium S into the opened one of the branch paths, the outer peripheral portions of the runner rollers 150 are to project into the opened branch path relative to the guiding surface of the chute 180 that defines the closed branch path.

Furthermore, the link arms 103 are to be placed in the recesses 190 such that the medium S is not drawn into the closed branch path and the link arms 103 do not interrupt the medium S that is guided toward the opened branch path. The link arms 103 when placed in the recesses 190 may be out of contact with the bottoms of the recesses 190.

Exemplary Operation of Path Switcher

Switching Mode I

Figure 9A:
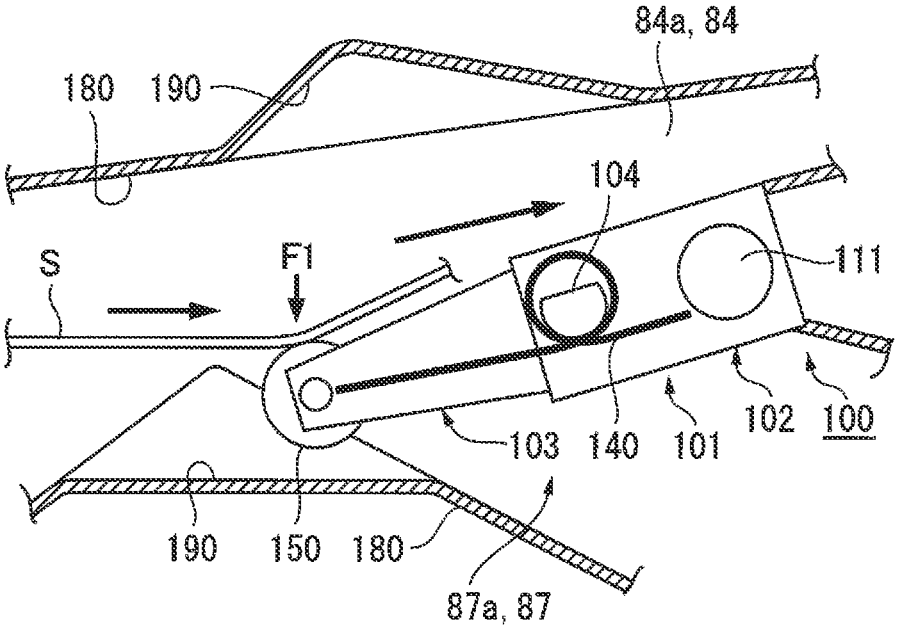
FIG. 9A schematically illustrates how the path switcher closes a second branch path to open a first branch path.

In Switching Mode I, referring to FIG. 9A, the switching gate 101 closes the transport-path branch 87 corresponding to the second branch path to open the straightforward transport path 84*a* corresponding to the first branch path.

In the present exemplary embodiment, the medium S guided toward the straightforward transport path 84*a* first comes into contact with the runner rollers 150 at the distal end of the switching gate 101 moved to close the transport-path branch 87 and is then guided along guiding surfaces of the link arms 103 and the swing arm 102 of the switching gate 101.

In this process, when the medium S comes into contact with the runner rollers 150, the runner rollers 150 receive from the medium S an external force F1, which pushes down the runner rollers 150. When the external force F1 that pushes down the runner rollers 150 is thus exerted, the swing arm 102 does not move but the link arms 103 temporarily retract against the urging force of the helical torsion springs 140 in such a manner as to rotate downward by the play δ about the motion-allowing part 104. Accordingly, the contact pressure between the medium S and the runner rollers 150 is reduced. Therefore, the medium S is not strongly pressed against the runner rollers 150 of the switching gate 101 and causes the runner rollers 150 to rotate. Thus, the medium S is transported into the branch path opened by the switching gate 101.

Furthermore, the link arms 103 and the runner rollers 150 of the switching gate 101 are placed into the recesses 190 provided in the chute 180 that defines the closed branch path (in the present exemplary embodiment, the transport-path branch 87). Therefore, the medium S is not drawn into the closed branch path.

Switching Mode II

Figure 9B:
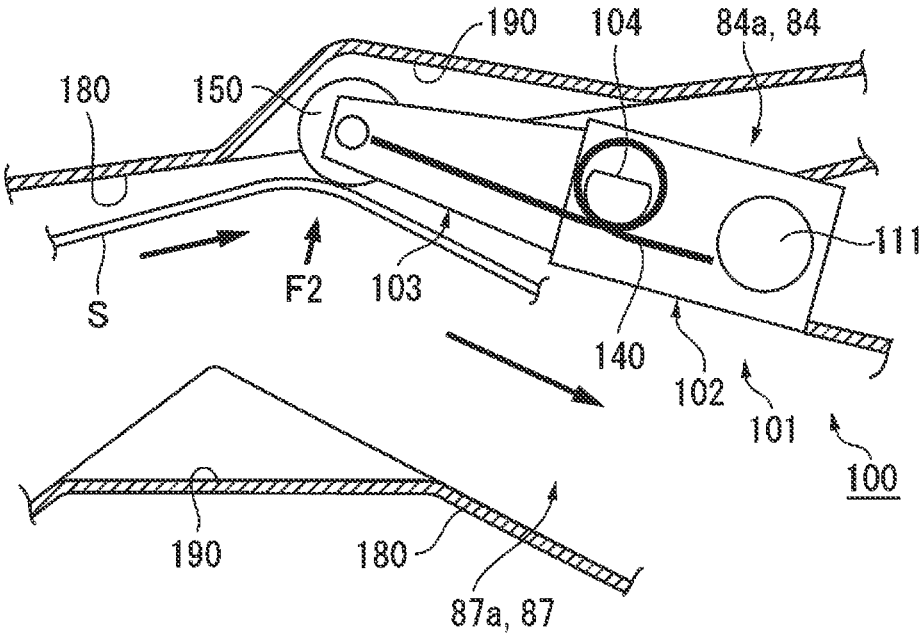
FIG. 9B schematically illustrates how the path switcher closes the first branch path to open the second branch path.

In Switching Mode II, referring to FIG. 9B, the switching gate 101 closes the straightforward transport path 84*a* corresponding to the first branch path to open the transport-path branch 87 corresponding to the second branch path.

In the present exemplary embodiment, the medium S guided toward the transport-path branch 87 first comes into contact with the runner rollers 150 at the distal end of the switching gate 101 moved to close the straightforward transport path 84*a* and is then guided along guiding surfaces of the link arms 103 and the swing arm 102 of the switching gate 101.

In this process, when the medium S comes into contact with the runner rollers 150, the runner rollers 150 receive from the medium S an external force F2, which pushes up the runner rollers 150. When the external force F2 that pushes up the runner rollers 150 is thus exerted, the swing arm 102 does not move but the link arms 103 temporarily retract against the urging force of the helical torsion springs 140 in such a manner as to rotate upward by the play δ about the motion-allowing part 104. Accordingly, the contact pressure between the medium S and the runner rollers 150 is reduced. Therefore, the medium S is not strongly pressed against the runner rollers 150 of the switching gate 101 and causes the runner rollers 150 to rotate. Thus, the medium S is transported into the branch path opened by the switching gate 101.

Furthermore, the link arms 103 and the runner rollers 150 of the switching gate 101 are placed into the recesses 190 provided in the chute 180 that defines the closed branch path (in the present exemplary embodiment, the straightforward transport path 84*a*). Therefore, the medium S is not drawn into the closed branch path.

In terms of evaluating the performance of the path switcher 100 according to the present exemplary embodiment, the performance of path switchers according to first and second comparative embodiments will now be examined.

First Comparative Embodiment

In the first comparative embodiment, the switching gate includes only the swing arm. Therefore, the distal end of the swing arm directly comes into contact with the medium.

In such a configuration, the following scheme tends to be employed. To eliminate the gap between the switching gate and the branch path, the swing arm has members arranged in the form of comb teeth at the distal end thereof. Furthermore, the recesses provided in each of the chutes that define the respective branch paths are shaped such that when a corresponding one of the branch path is closed by the switching gate, the comb teeth at the distal end of the switching gate extend beyond the guiding surface of the chute.

In such a scheme, however, when the medium comes into contact with the distal end of the switching gate, the comb teeth at the distal end of the swing arm tend to be strongly pressed against the medium. Consequently, linear scratches may be made in the medium.

Second Comparative Embodiment

In the second comparative embodiment, the switching gate includes runner rollers provided at the distal end of the swing arm. Therefore, the runner rollers directly come into contact with the medium.

In the second comparative embodiment, the runner rollers come into contact with the medium while rotating. Therefore, the frictional resistance generated between the medium and the runner rollers is smaller than in the case where the distal end of the swing arm directly comes into contact with the medium. However, in the process of guiding the medium toward the opened branch path, when the medium comes into contact with the runner rollers of the switching gate located in the closed branch path and applies an external force to the runner rollers, the swing arm does not move. Accordingly, the external force from the medium does not cause the runner rollers to retract. Therefore, the medium is guided toward the opened branch path while being strongly pressed against the runner rollers. Consequently, the medium tends to have linear marks made by the runner rollers.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A path switcher provided at a point of branching of a transport path along which a medium is to be transported and where the transport path branches out into a first branch path and a second branch path that are to be switched between by the path switcher, the path switcher comprising:

a switching component comprising:

a first arm that is swingable at the point of branching of the transport path, the first arm being a flat plate extending in a width direction of the medium, and the width direction intersecting a direction of transport of the medium; and a second arm connected to a distal end of the first arm with an aid of a motion-allowing part, the second arm being a stick and being one of a plurality of second arms arranged in a form of comb teeth at predetermined intervals in the width direction of the medium, wherein the switching component is configured to close one of the first branch path and the second branch path while opening another of the first branch path and the second branch path;

an elastic retaining component provided around the motion-allowing part and configured to elastically retain the first arm and the second arm in a predetermined positional relationship; and a rotary component rotatably provided at a distal end of the second arm and that is to come into contact with the medium.

2. The path switcher according to claim 1, wherein the rotary component is one of a plurality of rotary components provided to all or some of the plurality of second arms in such a manner as to be arranged at intervals.

3. The path switcher according to claim 2, wherein the first branch path and the second branch path are each defined by a defining member having a recess in which the second arms and the rotary components are to be placed as a result of a switching motion of the switching component.

4. The path switcher according to claim 1, wherein an outer peripheral portion of the rotary component projects toward the first branch path or the second branch path relative to the second arm at a position where the rotary component is attached to the second arm.

5. The path switcher according to claim 4, wherein the second arm is thinner on a side where the rotary component is attached to the second arm than on a side where the second arm is connected to the first arm.

6. The path switcher according to claim 1, wherein the elastic retaining component is configured to retain the first arm and the second arm to be aligned in a substantially straight line.

7. The path switcher according to claim 6, wherein the elastic retaining component is a helical torsion spring wound around the motion-allowing part and including two end hooks that are respectively made to engage with the first arm and the second arm.

8. A medium-transporting device comprising:

the path switcher according to claim 1 provided at the point of branching between the first branch path and the second branch path;

the first branch path and the second branch path branching out from the transport path along which the medium is to be transported; and a transporting component configured to transport the medium.

9. A medium-processing apparatus comprising:

the medium-transporting device according to claim 8; and a processing component configured to perform a predetermined processing operation on a medium that is transported by the medium-transporting device.

10. A path switcher provided at a point of branching of a transport path along which a medium is to be transported and where the transport path branches out into a first branch path and a second branch path that are to be switched between by the path switcher, the path switcher comprising:

means for switching the transport path, the means for switching comprising:

a first arm that is swingable at the point of branching of the transport path, the first arm being a flat plate extending in a width direction of the medium, and the width direction intersecting a direction of transport of the medium; and a second arm connected to a distal end of the first arm with an aid of a motion-allowing part, the second arm being a stick and being one of a plurality of second arms arranged in a form of comb teeth at predetermined intervals in the width direction of the medium, wherein the means for switching is configured to close one of the first branch path and the second branch path while opening another of the first branch path and the second branch path;

means for elastically retaining the first arm and the second arm in a predetermined positional relationship, the means for elastically retaining being provided around the motion-allowing part; and means for rotatably coming into contact with the medium, the means for rotatably coming being provided at a distal end of the second arm.

* * * * *